United States Patent [19]

Bilkie

[11] Patent Number: 4,553,422

[45] Date of Patent: Nov. 19, 1985

[54] TAP DUCT CRIMPING TOOL

[76] Inventor: Robert M. Bilkie, 6936 Gillman, Garden City, Mich. 48135

[21] Appl. No.: 678,588

[22] Filed: Dec. 5, 1984

[51] Int. Cl.[4] ..... B21J 13/08

[52] U.S. Cl. ..... 72/458; 72/409; 29/243.55

[58] Field of Search ..... 72/478, 482, 458, 409, 72/410; 29/243.5, 243.52, 243.55, 283.5; 81/425 A, 425 R, 426

[56] References Cited

U.S. PATENT DOCUMENTS

| | | | |
|---|---|---|---|
| 2,255,368 | 9/1941 | Smith | 72/409 |
| 2,572,738 | 10/1951 | Lovinggood | 81/15 |
| 3,330,147 | 7/1967 | Wieters | 72/409 |
| 3,570,299 | 3/1971 | Wieters | 72/409 |
| 3,961,518 | 6/1976 | Osbolt | 72/409 |

*Primary Examiner*—Francis S. Husar
*Assistant Examiner*—Linda McLaughlin
*Attorney, Agent, or Firm*—Andrew E. Pierce

[57] ABSTRACT

A tool for securing a tap duct to an opening in a tap duct sized main duct having a base structure for extending transversely across and seating in supported relationship against the exterior open end of a tap duct flanged at the opposite end; an anvil structure movable so as to force the flanged end of said tap duct outwardly and toward the interior wall of a main duct; manually activated bending structure mounted on said base structure suitable for extending said anvil structure against the flanges of said tap duct outwardly and toward the interior wall of said main duct.

6 Claims, 9 Drawing Figures

TAP DUCT CRIMPING TOOL

BACKGROUND OF THE INVENTION

1. Field of the Invention

This invention relates generally to bending tools for installing and assembling heating and ventilating system ducts and more particularly to a tool for joining a tap duct, or feeding duct, to a main duct.

2. Description of the Prior Art

In the installation of ducts for heating and ventilating systems, a number of tap ducts are required to feed individual rooms. These tap ducts, which are attached to a main duct, are substantially smaller in cross sectional area than the main duct. The common method of installation is to cut an opening in the main duct wall, insert the tap duct therein, and peen over the duct flange material which extends into the interior of the main duct. Generally a workman may insert a hammer therein to peen over the attached flange material. This is not a simple task and the time involved to peen over these individual units is quite substantial when a number of such installations must be made.

Various duct clenching or crimping devices and tools have been provided in the prior art. In particular, the hand crimper of U.S. Pat. No. 2,572,738 and the crimpers of U.S. Pat. Nos. 3,330,147 and 3,570,299. These crimping tools have not been entirely satisfactory, as evidenced by the lack of acceptance by those in the business of installing and assembling heating and ventilating systems. One reason for their lack of acceptance may be the fact that each of these hand crimpers require clenching a fist around the levers of the tool much like the action involved in the closing of a pair of pliers. This action can become very tiring to the operator upon extended use of the tool.

It is therefore an object of the applicant's invention to provide a duct crimping tool wherein the crimping mechanism requires pushing a handle perpendicularly against the orifice of the tap duct. Use of such force is intended to prevent excessive tiring of the worker installing such tap ducts. This object together with various ancillary objects and features of the invention which will later become apparent as the following description proceeds, are attained by the inventive tap duct crimping tool disclosed herein, a preferred embodiment of which has been illustrated by way of example only in the accompanying drawings.

SUMMARY OF THE INVENTION

This invention relates to a new and improved tap duct crimping tool intended for use in the installation and assembly of heating and ventilating systems, more particularly to a tool for bending a series of flanges of a feeding duct member (tap duct) into secure engagement with the wall of a main duct. The new and improved tap duct crimping tool includes a base member suitable for extending in a diametrical or transverse direction across the exterior orifice of a tap duct opposite to the interior end or base of said duct which contains a series of engaging flanges. Pivotably attached to said base member is a handle member having integrally attached thereto a front leg member assembly interiorly extending when the tool is in use toward the engaging flanges at the base of the tap duct and disposed at a substantially perpendicular angle to said handle member. Said front leg member assembly comprising an adjusting screw, front leg member integrally attached to said handle member and slidably attached to said front leg member, an anvil leg member having at the interiorly extending end of said anvil leg member a crimping face extending substantially perpendicular to said anvil leg member and adapted for crimping a series of flanges of said duct so as to force them into secure engagement and parallel with the wall of said main duct. A rear leg member assembly is also provided comprising a slidably attached retaining plate, a leg member integral therewith, a slidably attached foot member, and an adjusting screw, said leg member interiorly extending when the tool is in use into said duct at a substantially perpendicular angle to said base member. The slidably attached foot member is adapted for engagement against the inside wall of the tap duct so as to mate with an annular expanded wall area of the tap duct adjacent to the flanges of said tap duct.

BRIEF DESCRIPTION OF THE DRAWINGS

Like reference numbers indicate like parts in the several views of the drawings.

DESCRIPTION OF THE PREFERRED EMBODIMENT

Figure 2:
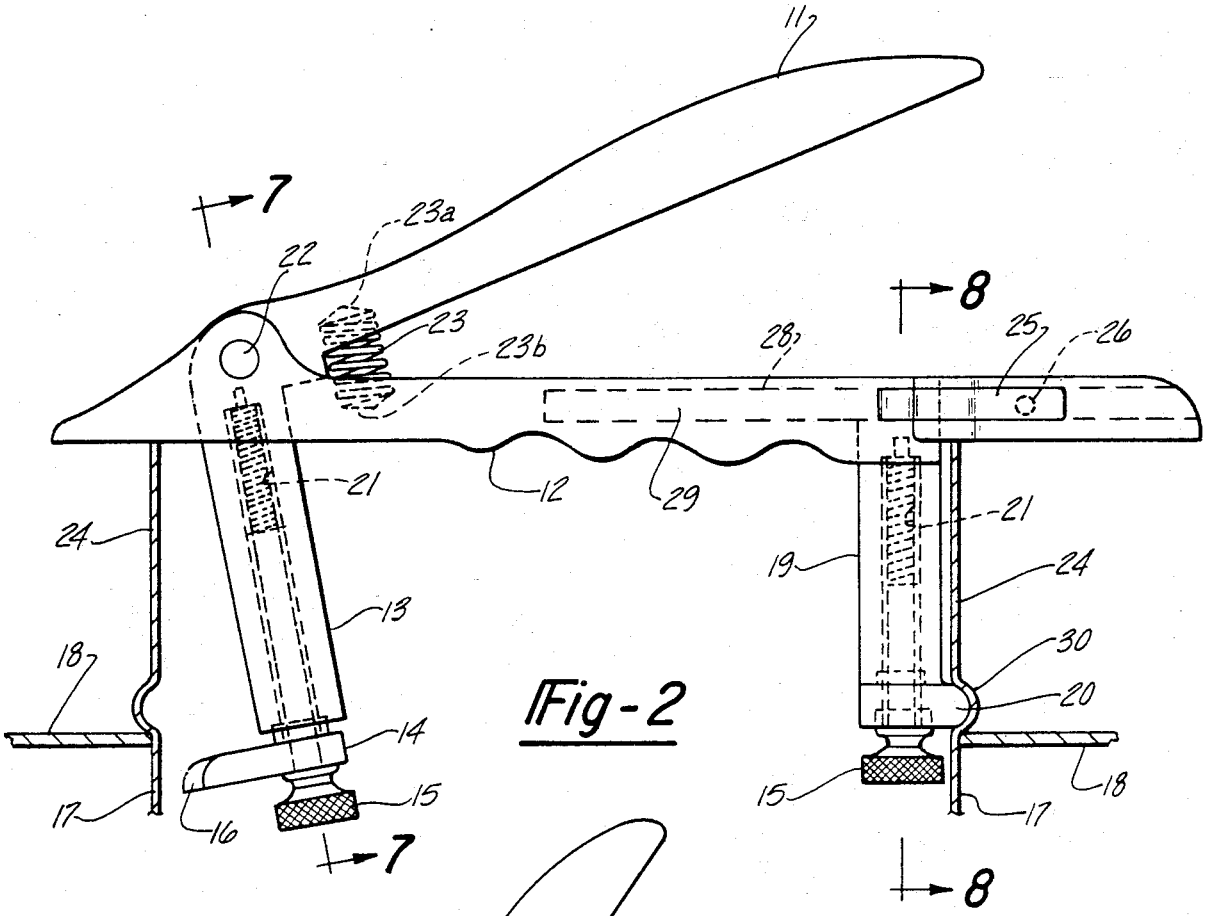
FIG. 2 is a side elevational view illustrating the tool in position for crimping a tap duct to a main duct.
Figure 1:
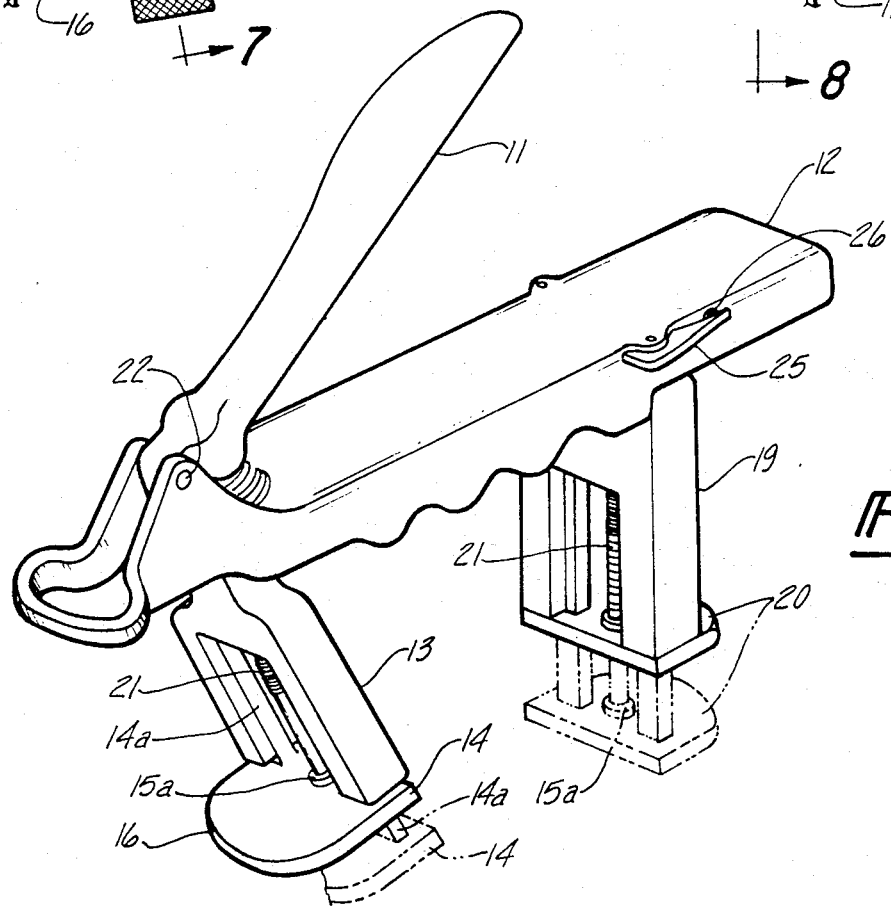
FIG. 1 is an isometric view of one embodiment of the invention showing the extendable front anvil and rear foot members.
Figure 5:
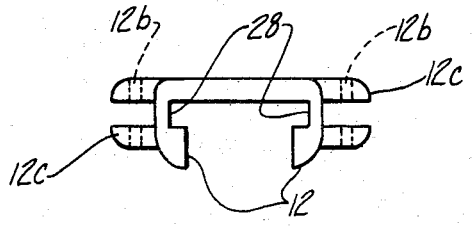
FIG. 5 is a sectional view taken along 5—5 of FIG. 4 of the base member illustrating the slotted undersurface of said base member.

As shown in FIGS. 1 and 2 of the accompanying drawings, the preferred embodiment of the tap duct crimping tool of the invention is bending means comprising a manually activated lever means consisting of a handle member 11 pivotably attached to a base member 12 by pivot pin 22. Said handle member has a duct-engaging front leg member assembly comprising a front leg member 13 integrally attached to said handle member, an anvil member 14, and a knurled adjusting screw 15. In use, said assembly extends interiorly into said duct toward the flanged portion thereof at a substantially perpendicular angle to said handle member. Said anvil member 14 is slidably attached to said leg member 13 and has at the interiorly extending end of said leg member 13 a crimping face 16 extending substantially perpendicularly to said anvil leg member 14 and adapted for crimping an internal flange 17 of said tap duct so as to force it into engagement with a main duct 18. In use, a force exerting means consisting of a rear leg member assembly comprising a rear leg member 19 integrally attached to retaining plate 29 in FIG. 5, a duct engaging foot member 20 engages annular expanded area 30 of tap duct 24 and a knurled adjusting screw 15 extends into attachment orifice 21 of rear leg member 19 at a substantially perpendicular angle to said base member 12. Said rear leg member assembly is slidably attached to base member 12 by means of retaining plate 29. Foot member 20 is slidably attached at leg member 20*a* in groove 19*a* to said rear leg member assembly 19 and adapted to mate with an annular expanded area 30 of tap duct 24 adjacent to flanges 17.

Said duct-engaging foot member 20 and said anvil leg member 14 are adjustable to varying depths of tap duct by the use of said knurled adjusting screws 15 having a head and an externally threaded shaft 15*b*, said shaft 15*b* inserted respectively through internally threaded attachment orifices 21 located in the front member 13 and rear leg member 19. Retaining rings 15*a* are securely attached to adjusting screws 15 utilizing a pin or set screw. Said retaining rings are positioned on the opposite side of anvil member 14 and foot member 20 to that at which the knurled screw head 15 is located.

Figure 3:
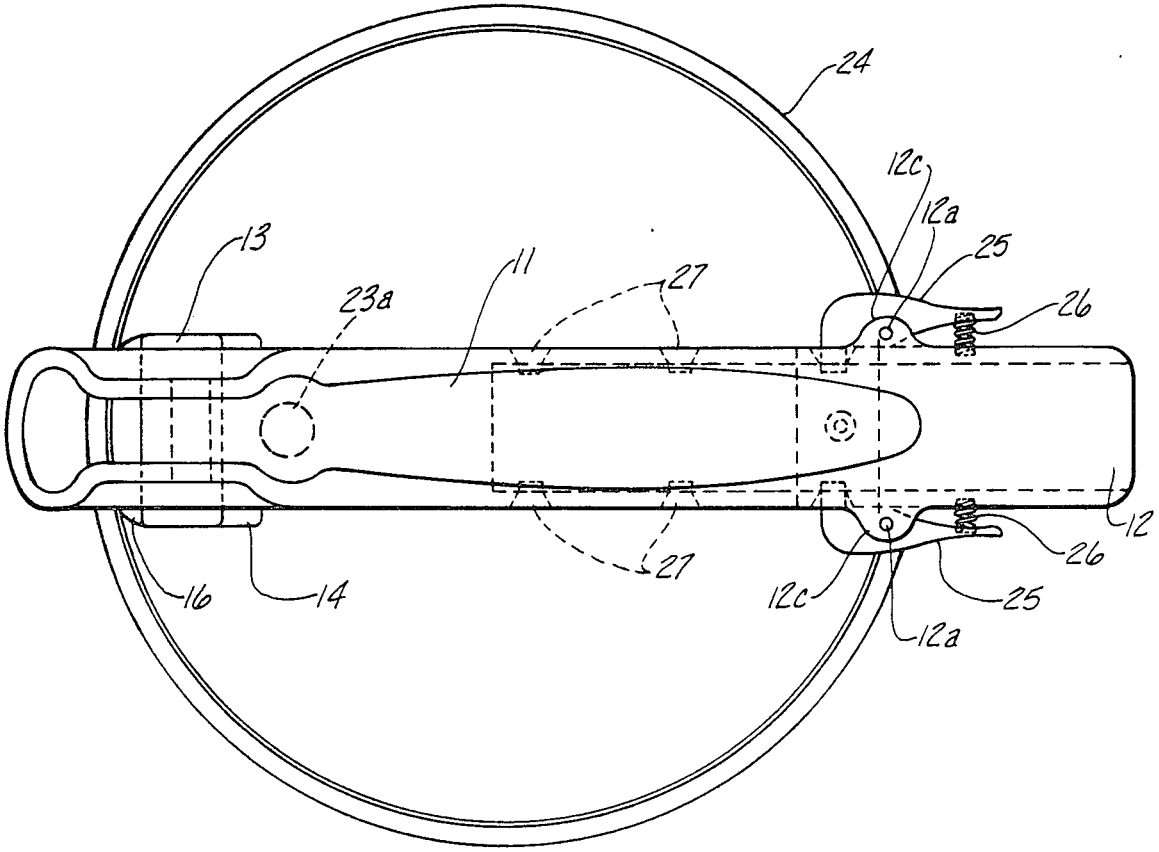
FIG. 3 is a plan view showing the base member of the tool slotted at one end for receiving a rear leg member which is slidably attached to said base member.
Figure 6:
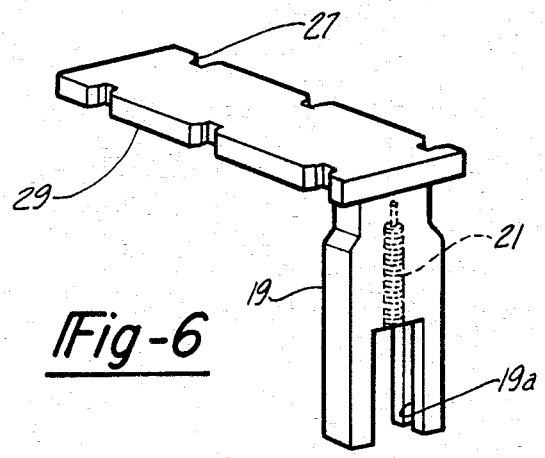
FIG. 6 is an isometric view of the rear leg member and retaining plate.

Said rear leg member assembly is adjustable to accommodate various diameters of tap duct by means of slotted openings 27 in the retaining plate 29 as shown in FIG. 6 which is integral with rear leg member 19 and slidably attached to said base member 12 and secured in an adjusted position by locking members 25 pivotably attached by pivot pin 12*a* in orifice 12*b* of extended portion 12*c* of base member 12. Said locking members are held in locked position with coil springs 26 connected in compression between base member 12 and said locking members 25, as shown in FIG. 3. Said handle 11 is pivotably attached by pin 22 to said base member 12. Located in orifices 23*a* and 23*b* in said handle member 11 and said base member 12 is a coil spring 23 connected in compression between the front ends of said handle 11 and said base member 12 so as to maintain apart said handle member 11 and said base member 12 when no force is exerted on said handle member 11.

Figure 4:
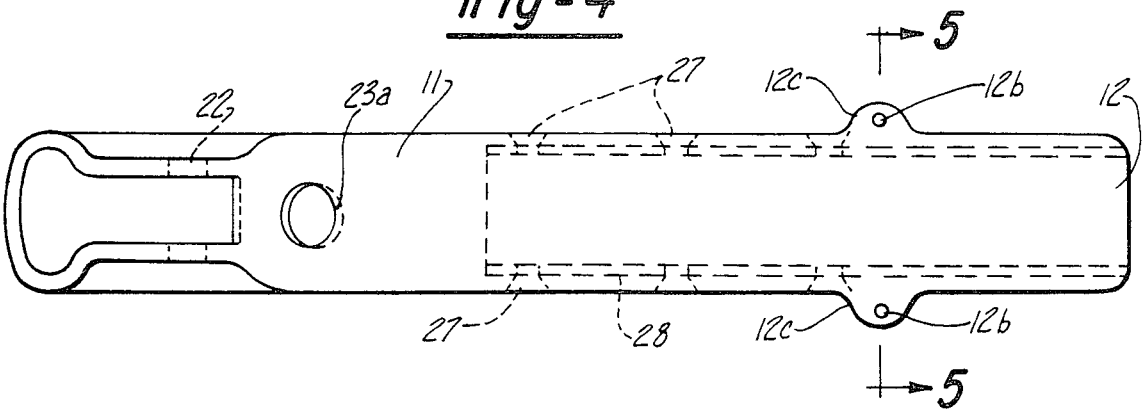
FIG. 4 is a plan view of the base member.

As shown in FIG. 4, the rearwardly extending portion of base member 12 is slotted at 28 in FIG. 2 to receive retaining plate 29 integrally attached to rear leg member 19, as more easily seen in the isometric view of retaining plate 29 and rear leg member 19 in FIG. 6. The slotted portion of base member 12 is shown in sectional view taken along 4—4 in FIG. 5.

Figure 7:
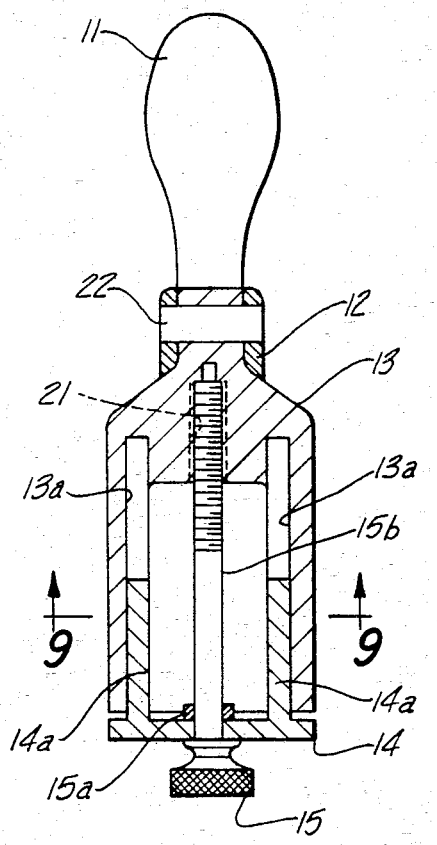
FIG. 7 is a sectional view taken along 7—7 of FIG. 1 of the rear leg member assembly illustrating the slidable attachment of the foot member to the slotted retaining plate and the slidable attachment of the retaining plate to the base member.

As shown in FIG. 7, which is a sectional view taken along 7—7 of FIG. 2, front leg member 13 slidably receives anvil legs 14*a*. The anvil leg member 14*a* slides within the slotted portion 13*a* of front leg 13 and is adjustable for varing lengths of tap duct by adjustment screw 15.

Figure 8:
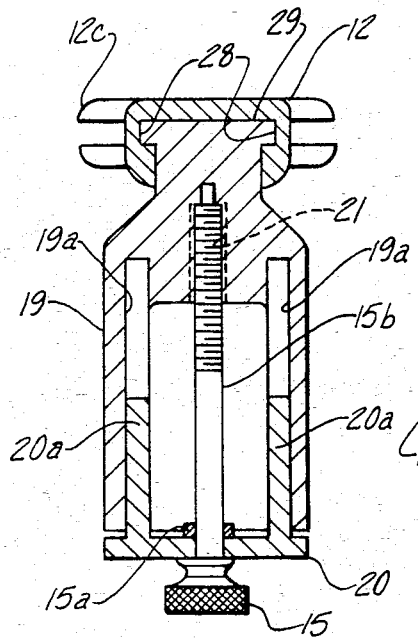
FIG. 8 is a sectional view taken along 8—8 of FIG. 1 illustrating the front leg member assembly and showing the front leg member integrally attached to the handle member.
Figure 9:
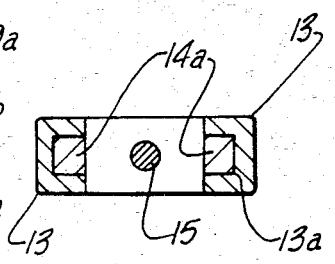
FIG. 9 is a sectional view taken along 9—9 of FIG. 7 illustrating the slidable attachment of the flange-engaging anvil portion of the front leg member.

As shown in FIG. 8, which is a sectional view taken along 8—8 in FIG. 2, the rear leg member assembly comprising retaining plate 29 and integrally attached rear leg member 19 is slidably attached to base member 12. Rear leg member 19 receives leg member 20*a* which slides within the slotted portion 19*a* of rear leg member 19.

In use the tap duct crimping tool is placed into the stub of the tap duct 24 and properly adjusted for the diameter and depth of tap duct 24 utilizing adjustment screws 15 and pivotably attached locking members 25. Thereafter handle 11 is closed by forcing it against base 12 which extends foot 16 against flange 17 of tap duct 24 so as to force the flange into engagement with the wall of the main duct 18. Handle member 11 is returned to an open position with respect to base member 12 by the action of the coil spring 23 subsequent to the crimping operation. The tool is rotated sufficiently to be in position to engage an adjacent flange of the tap duct and the handle pressed down so as to force the flange into engagement with the wall of the main duct. Successive rotational movement of the tool and downward operation of the handle to force adjacent flanges into engagement with the main duct completes the operation of joining the tap duct to the main duct.

Alternatively, in another embodiment of the tap duct crimping tool of the invention, instead of a swinging movement of the above described front leg member assembly so as to force an anvil member thereof against a flange of a tap duct, said flange can be moved into secure engagement with the interior wall of a main duct by the use of a cam rod actuated anvil member. Said cam rod is forced into engagement with said anvil member by forcing downwardly and substantially parallel to a base member a handle pivotably attached to said base member.

In view of the foregoing description taken in conjunction with the accompanying drawings, it is believed that a clear understanding of the device will be quite apparent to those skilled in this art. The tool described herein is useful for joining tap and main ducts, said tap ducts having any of circular or rectangular shapes to main ducts having a rectangular shape. A more detailed description is accordingly deemed unnecessary. It is to be understood, however, that even though there is herein shown and described preferred embodiments of the invention, the same are susceptible to certain changes fully comprehended by the spirit of the invention as herein described and the scope of the appended claims.

The embodiments of the invention in which an exlusive property or privilege is claimed are defined as follows:

1. A bending tool for securing a tap duct to a main duct wherein the tap duct has a flanged interior end extending into the main duct through an opening therein and also has an open exterior end, said tool comprising:

(a) base means for extending transversely across and seating in supported relationship against the exterior open end of the tap duct;

(b) a handle means pivotably attached to said base means;

(c) a rear leg assembly attached to said base means, said rear leg assembly adapted to extend interiorly into said duct, said rear leg assembly having a rear leg means, a retaining plate integrally attached thereto, and a duct-engaging foot means; and wherein said foot means is slidably attached to said rear leg assembly; and (d) manually actuated bending means mounted on said base means for extending therefrom into the open end of said tap duct and having anvil means movable in a bending movement upon actuation of said bending means for bending a flange of said flanged end outwardly of said tap duct and toward the interior surface of said main duct adjacent to said opening; said bending means comprising a duct-engaging front leg assembly including a front leg integrally attached to said handle and adapted to extend into said duct and an anvil means slidably attached to said front leg means and having a duct-engaging crimping face; wherein said front leg extends substantially perpendicular to said handle means and is adjustable so as to accommodate tap ducts of varying depths.

2. The bending tool of claim 1, said bending means comprising:

(a) manually actuated lever means cooperable with said anvil means for moving the latter in said bending movement; and (b) force exerting means mounted upon said base means for extending into the open end of said tap duct and engaging the interior surface of the latter at a location essentially opposite to said anvil means for counterbalancing the force required for said bending movement.

3. The bending tool of claim 2 wherein said base means is slotted at an end of said base means opposite to the pivotable attachment of said handle means so as to receive said rear leg assembly which is slidably attached to said base means at said retaining plate and adjustable so as to accommodate said tool to tap ducts having varying diameters.

4. The bending tool of claim 3 wherein said handle means is positioned at an angle to said base means by a coil spring connected in compression between said handle means and said base means.

5. The bending tool of claim 4 wherein said tool is adapted for crimping a series of flanges located at the base of said top duct by successive positioning of said bending tool base means across the orifice of said tap duct and successive forcing of said handle means toward said base means so that said handle means is substantially parallel to said base means, wherein said crimping face of said anvil leg means is forced to swing against said tap duct flanges so as to move said flanges from a position substantially perpendicular to the wall of said main duct to a position substantially parallel to the wall of said main duct.

6. The bending tool of claim 5 wherein said coil spring is disposed within opposing orifices in said handle means and said base means.

* * * * *